US006374919B1

(12) United States Patent
Neill

(10) Patent No.: US 6,374,919 B1
(45) Date of Patent: Apr. 23, 2002

(54) CONCEALED HORIZONTAL SIDEWALL SPRINKLER ARRANGEMENT

(75) Inventor: John Neill, Edgewater, NJ (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 0 days.

(21) Appl. No.: 09/551,080

(22) Filed: Apr. 18, 2000

(51) Int. Cl.[7] ..... A62C 37/08

(52) U.S. Cl. ..... 169/37; 169/38; 169/39; 169/40; 169/41

(58) Field of Search ..... 169/37–41, 51, 169/90, 91; 239/504, 518, 498, DIG. 1, 521, 522, 524

(56) References Cited

U.S. PATENT DOCUMENTS

| | | | | | |
|---|---|---|---|---|---|
| 4,014,388 | A | * | 3/1977 | Anderson | 169/37 |
| 4,596,289 | A | * | 6/1986 | Johnson | 169/37 |
| 4,618,001 | A | * | 10/1986 | Hoening | 169/38 |
| 4,880,063 | A | | 11/1989 | Leininger et al. | 169/37 |
| 4,926,946 | A | * | 5/1990 | Polan | 169/51 |
| 5,080,176 | A | | 1/1992 | Polan et al. | 169/37 |
| 5,083,616 | A | | 1/1992 | Polan | 169/40 |
| 5,097,906 | A | | 3/1992 | Polan | 169/37 |
| 5,152,344 | A | | 10/1992 | Fischer et al. | 169/37 |
| 5,447,338 | A | | 9/1995 | Kikuchi | 285/46 |
| 5,609,211 | A | | 3/1997 | Meyer et al. | 169/37 |
| 5,647,438 | A | | 7/1997 | Chatrathi et al. | 169/58 |
| 5,687,914 | A | | 11/1997 | Bosio et al. | 239/498 |
| 5,727,737 | A | | 3/1998 | Bosio et al. | 239/504 |

* cited by examiner

*Primary Examiner*—Henry C. Yuen
*Assistant Examiner*—Davis Hwu
(74) *Attorney, Agent, or Firm*—Baker Botts L.L.P.

(57) ABSTRACT

In the representative embodiments described in the specification, a concealed horizontal sidewall sprinkler has a sprinkler body adapted to be connected to a source of fire extinguishing liquid. A cover support is mounted substantially concentrically to the sprinkler body and has a threaded cylindrical wall extending away from the source of fire extinguishing liquid. The threaded cylindrical wall engages a sleeve which at one end has a slotted cylindrical portion with helically arranged projections to be received in the threads of the threaded cylindrical wall of the cover support. The other end of the sleeve has a flange with a plurality of tabs extending away from the cylindrical portion. A cover is attached by solder to the tabs extending from the flange of the sleeve. The cover also has four slots and is spaced from the flange of the sleeve by the tabs forming an annular gap. Two springs affixed to the flange are interposed between the flange and the cover for urging the cover away from the sleeve when the solder fuses at elevated temperatures. The cover can be frustoconical in shape and the centerline of each slot in the cover can extend substantially in a plane with the axis of the frustoconically shaped cover.

18 Claims, 4 Drawing Sheets

CONCEALED HORIZONTAL SIDEWALL SPRINKLER ARRANGEMENT

BACKGROUND OF THE INVENTION

This invention relates to horizontal sidewall sprinklers for distributing liquid from a sidewall of an environment which is subject to a fire hazard, and more particularly, relates to a concealed horizontal sidewall sprinkler having a cover.

The Bosio et al. U.S. Pat. No. 5,727,737, the disclosure of which is incorporated herein by reference, discloses a horizontal sidewall sprinkler having a sprinkler body and deflector. The Bosio et al. U.S. Pat. No. 5,687,914, the disclosure of which is incorporated herein by reference, discloses a pendent-type sprinkler suspended in an opening in a ceiling plate and having a cylindrical portion with slots and helically arranged projections between the slots to permit mounting and removal of a cover assembly on a threaded cylindrical wall of a cup mounted on a sprinkler body by axial motion. That patent, as well as the Leininger et al. U.S. Pat. No. 4,880,063, the disclosure of which is incorporated herein by reference, discloses a gap between a cover supported from a cup-shaped member and an adjacent flange of the cup-shaped member. The Polan U.S. Pat. No. 5,097,906 discloses a concealed frame-type ceiling sprinkler arrangement suspended from a ceiling and having a frustoconical cover portion with slots extending along the sidewall of the cover. The Fischer et al. U.S. Pat. No. 5,152,344 discloses a concealed ceiling sprinkler having a cover assembly in which a cover is supported by soldered tabs extending from a flange of a cylindrical member and springs are arranged to urge the cover away from the flange when the solder is melted.

Covers are used with sprinklers mostly for aesthetic reasons. Nonetheless, a concealed horizontal sidewall sprinkler must have a sprinkler cover ejection mechanism that ensures complete and timely ejection of the cover prior to actuation of the sprinkler head and a venting arrangement that ensures proper and timely activation of the sprinkler. Further, a concealed horizontal sidewall sprinkler must have openings in its cover designed so that hot gases can reach the solder holding the cover in place to melt the solder quickly. Moreover, the cover must be ejected and the sprinkler must be actuated regardless of the orientation of the openings in the cover after installation. Finally, for aesthetic purposes, it is desirable to minimize the size of the cover openings.

SUMMARY OF THE INVENTION

Accordingly, it is an object of the present invention to provide a concealed horizontal sidewall sprinkler arrangement which overcomes disadvantages of the prior art.

Another object of the invention is to provide a concealed horizontal sprinkler arrangement installed in a sidewall and having a cover which is slidably mountable on a sprinkler.

These and other objects of the invention are attained by providing a concealed horizontal sidewall sprinkler arrangement mounted in a sidewall and having a sprinkler body adapted to be connected to a source of fire extinguishing liquid and a cover supported from the sprinkler body and having slots to permit air circulation. A cover support is mounted substantially concentrically to the sprinkler body and has a threaded cylindrical wall extending away from the source of fire extinguishing liquid. The threaded cylindrical wall engages a sleeve which at one end has a slotted cylindrical portion with helically arranged projections to be received in the threads of the threaded cylindrical wall of the cover support. The other end of the sleeve has a flange with a plurality of tabs extending away from the cylindrical portion. In a preferred embodiment, a cover has a flange portion attached by solder to the tabs extending from the flange of the sleeve and has a projecting portion extending away from the flange portion to accommodate the sprinkler body. The cover also has a plurality of slots and is spaced from the flange of the sleeve by the tabs, forming an annular gap. At least one spring is interposed between the flange and the cover for urging the cover away from the sleeve when the solder fuses at elevated temperatures. In another preferred embodiment, the projecting portion of the cover is frustoconical in shape and the centerline of each slot in the cover extends substantially in a plane extending through the axis of the frustoconically shaped cover.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
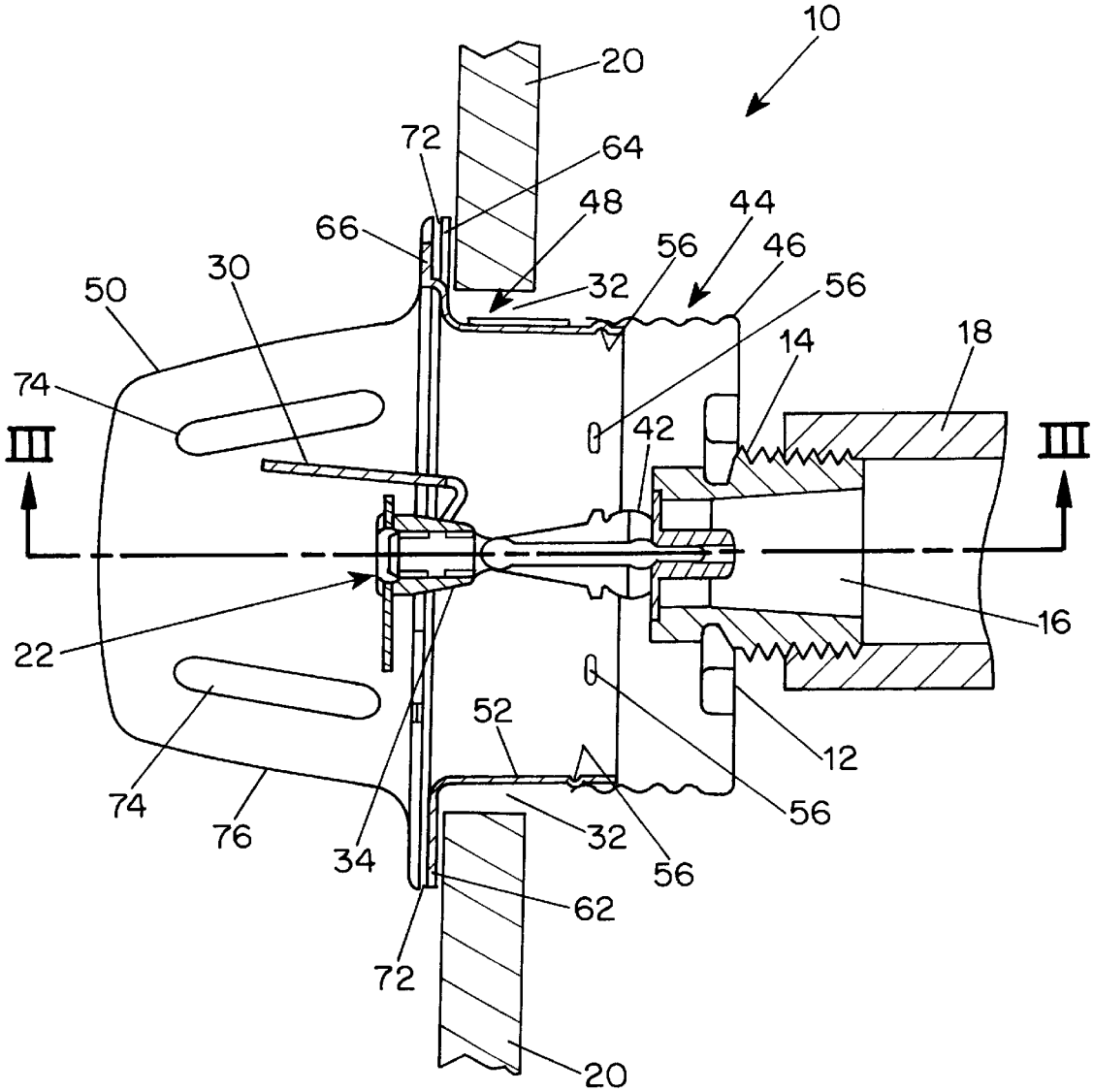
FIG. 1 is a side cross-sectional view illustrating a representative embodiment of a horizontal sidewall sprinkler arrangement in accordance with the invention.
Figure 2:
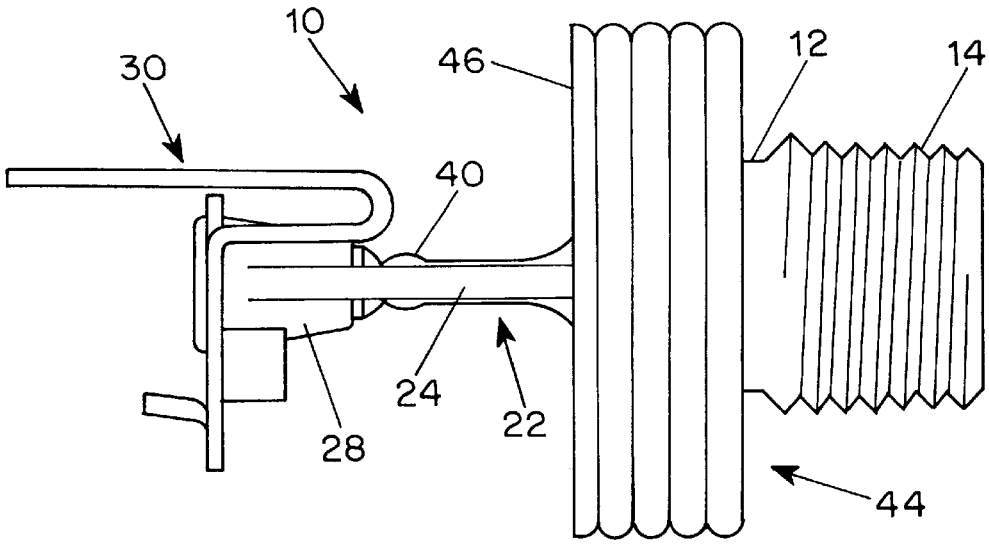
FIG. 2 is a side view illustrating the sidewall sprinkler body and cover support of the arrangement shown in FIG. 1.
Figure 3:
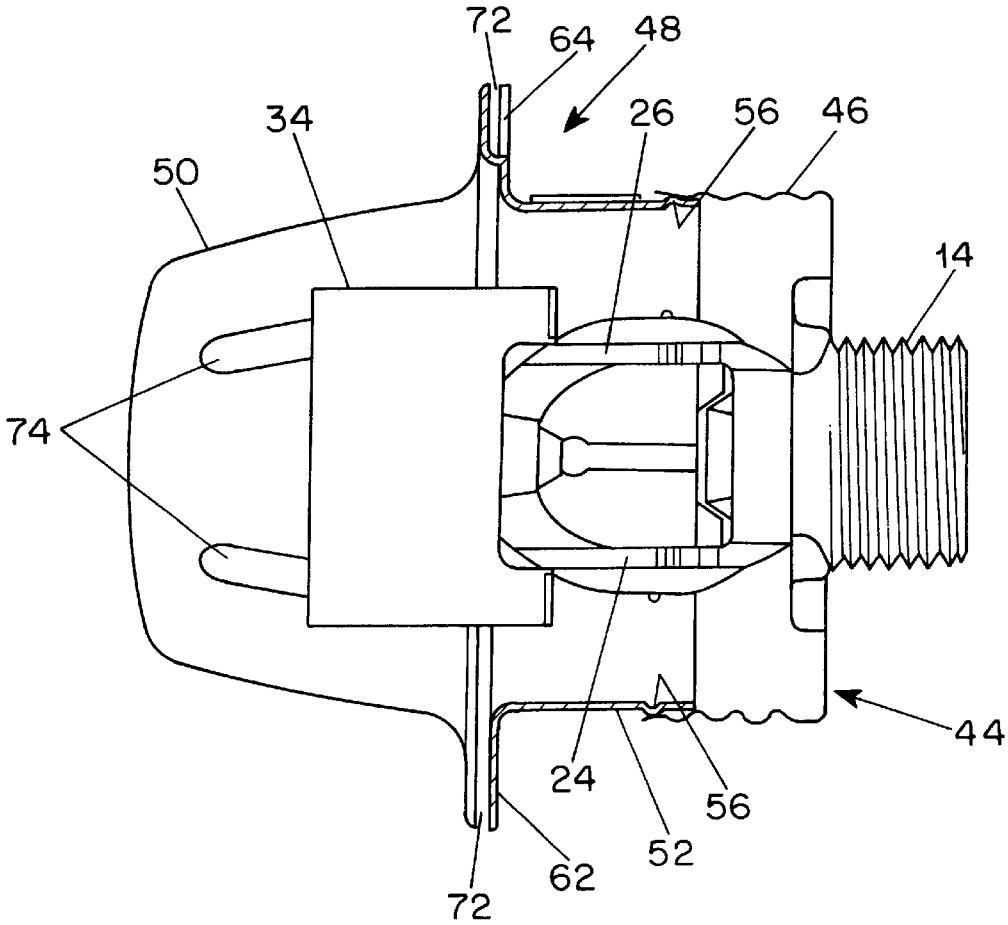
FIG. 3 is a longitudinal cross-sectional view of the sidewall sprinkler arrangement shown in FIG. 1 taken on the line III—III of FIG. 1 and looking in the direction of the arrows.
Figure 4:
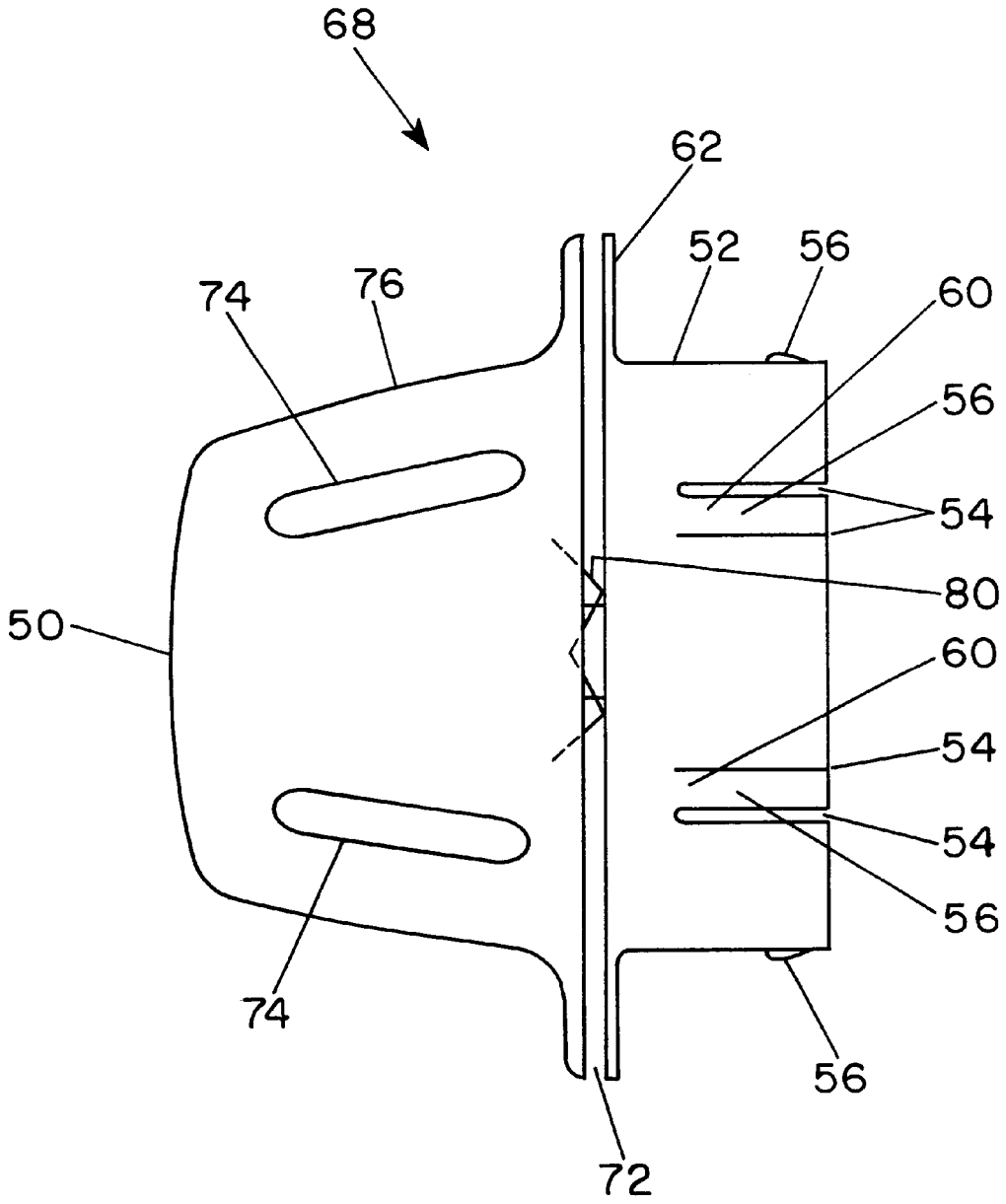
FIG. 4 is a top view of the sleeve and cover assembly shown in the embodiment of the invention illustrated in FIGS. 1 and 3.
Figure 5:
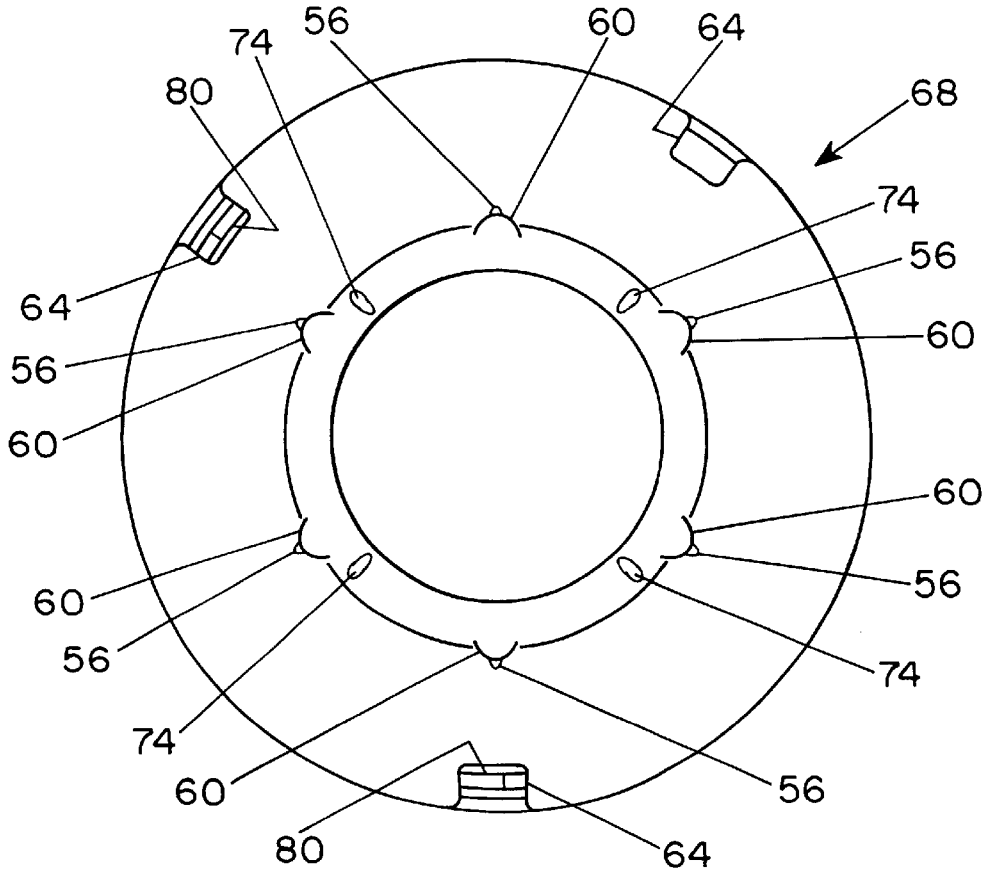
FIG. 5 is a back view of the sleeve and cover assembly of FIG. 4.

In the typical embodiment of the invention illustrated in the drawings, a horizontal sidewall sprinkler arrangement 10 includes a sprinkler body 12 housing a threaded end 14 which is formed in the usual manner with a central passage 16 and is adapted to be connected to a supply pipe 18 located at the upper portion of a sidewall 20 of the area to be protected for supplying a fire extinguishing liquid, such as water under pressure, to the sprinkler. At its other end, the sprinkler body 12 is formed with a frame 22 consisting of two spaced arms 24 and 26 which are joined in a boss 28 at the end remote from the threaded end 14 to support a deflector 30. The sprinkler 10 is supported in an opening 32 in the sidewall 20 so that the deflector 30 projects beyond the sidewall to distribute water over the area to be protected. The boss 28 has a surface 34 which diverges from the sprinkler axis in the direction away from the threaded end 14 and may have a conical shape or a parabaloidal shape to assist in distributing water energy from the passage 16. A thermally responsive element 40, such as a conventional glass bulb containing heat-expandable liquid or a conventional fusible solder element, is urged against a sealing member 42 which normally closes the liquid passage 16 in the sprinkler body.

A cover support 44 mounted on the sprinkler body 12 adjacent to the threaded end 14 has a threaded cylindrical wall 46 extending away from the threaded end 14 with an axis that is substantially perpendicular to the sidewall 20 and a diameter sufficiently large that the cylindrical wall 46 is farther from its axis than any portion of the deflector 30. The threaded cylindrical wall 46 supports a sleeve 48 which is coupled to a frustoconically-shaped cover 50 and extends at least substantially around the deflector 30. One end of the sleeve 48 has a cylindrical portion 52 with longitudinal slots 54 and helically arranged projections 56 located between the slots 54 and shaped to be received in the threads of the threaded cylindrical wall 46 of the cover support 44. The inwardly-directed side of each projection 56 is inclined and the outward side of each projection has an abrupt edge. The longitudinal slots 54 form movable segments 60 of the sleeve 48 which can be deflected to permit the sleeve to be mounted by axial motion on the threaded cylindrical wall 46. The helically arranged projections 56 also permit the cover 50 to be adjustably mounted with respect to the sprinkler by rotation of the sleeve 48.

The other end of the sleeve 48 has a flange 62 with three substantially equally spaced tabs 64 extending away from the cylindrical portion 52 but substantially parallel to the remainder of the flange. Two of the tabs 64 may be spaced farther apart from each other than each is spaced from the third tab. The frustoconically shaped cover 50 is attached by solder 66 to the tabs 64 to provide a sleeve and cover assembly 68. As a result of the tabs 64 extending away from the flange 62, there is an annular gap 72 between the flange 62 and the frustoconically shaped cover 50. The frustoconically shaped cover 50 has four long slots 74 substantially equally spaced apart around the frustoconical surface 76 of the cover 50. Each slot 74 extends substantially in a plane passing through the axis of the frustoconically shaped cover. The frustoconically shaped surface 76 has a height sufficient to enclose the portion of the sprinkler arrangement 10 which projects beyond the sidewall 20, for example from one half to two inches. The slots 74 and the annular gap 72 permit hot air from the region to be protected to circulate through the cover to fuse the solder 66 at elevated temperature. Because the four slots 74 are substantially equally spaced on the frustoconical cover 50, once the frustoconical cover is mounted on the cover support 44 during installation, its orientation relative to the ceiling and floor will not affect the actuation of the sprinkler. Preferably, the slots 74 are sufficiently narrow to minimize the ability of occupants to hang objects, such as clothes hangers from the covers 50 which could affect the ability of the sprinkler to actuate properly. The slots have a length in the range from about three quarters of an inch to one and a half inches and a width in the range from about one sixteenth inch to one quarter inch. Preferably the slots are approximately one inch in length and one eighth inch in width.

Figure 6:
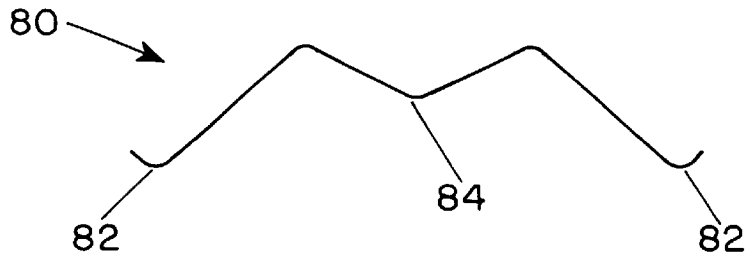
FIG. 6 is a side view of a representative leaf spring used in the embodiment shown in FIG. 1.
Figure 7:
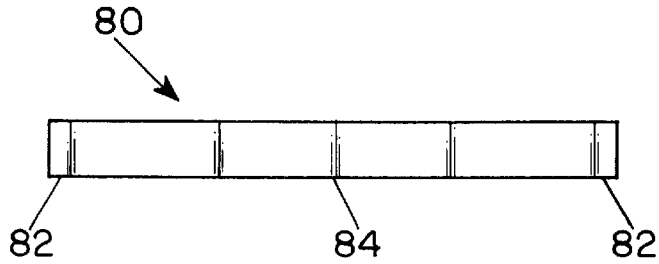
FIG. 7 is a top view of the leaf spring illustrated in FIG. 6.

In order to facilitate removal of the cover 50 when the solder 66 fuses, leaf springs 80 are inserted behind the tabs 64 to urge the cover 50 away from the flange 62. FIG. 6 depicts a leaf spring 80 which is substantially M-shaped. When the ends 82 of the spring 80 are squeezed together, the center section 84 of the M-shaped spring flattens out, easing insertion of the spring behind the tab. When the ends 82 are released, the center section 84 springs back against the tabs 82 and retains the spring in place.

It is important that the sprinkler body 12 and deflector 30 be clear of all obstructions prior to actuation of the sprinkler. A concealed ceiling sprinkler can rely at least partially on gravity to ensure that, when the solder fuses, the cover and springs clear the sprinkler deflector but gravity tends to cause the cover 50 and springs 80 for a sidewall sprinkler to fall toward the sprinkler body and deflector. To avoid the cover 50 being caught on the sprinkler body or deflector, the leaf springs 80 urge the cover away from the sprinkler body and deflector when the solder 66 fuses. The leaf springs 80 are retained by the flanges 62 and tabs 64 so that the springs 80 will not obstruct the sprinkler body or deflector when the cover is ejected. Because the orientation of the cover 50 on the cover support 44 can vary, at least two springs 80 are required. A single spring located at the bottom of the sprinkler arrangement, i.e., toward the floor, might be insufficient to provide reliable ejection of the cover 50 sufficient to clear the sprinkler body and the deflector. If two springs are used, the two tabs 64 by which the springs are retained should be spaced farther from each other along the outer perimeter of the flange 62 than from the third tab to ensure the cover 50 clears the sprinkler body 12 and the deflector 30.

When the ambient temperature exceeds a predetermined value, the thermally responsive element 40 fuses or disintegrates, permitting the water pressure in the passage 16 within the sprinkler body to eject the sealing member 42 so that the water is directed under pressure against the diverging boss 28 and deflector 30 for distribution over the area to be protected. The four slots 74 in the cover 50 and the annular gap 72 between the cover 50 and the cover support 44 permit circulation of hot air through the interior of the sleeve 48 and cover assembly 68 to expose the thermally responsive element 40 of the sprinkler arrangement 10 to the ambient temperature condition.

Underwriters Laboratories approval of concealed sprinklers is dependent on the ability of the cover to clear the sprinkler body and deflector and permit the sprinkler to actuate in one minute and fifteen seconds during a sensitivity, room heat test. The results of a test of five sprinklers similar to that of FIG. 1 but having no slots 74 in the cover, in which the sprinkler was installed so that the deflector 30 was twelve inches from the ceiling, are showing in Table I below.

TABLE I

| | OPERATING TIME (MINUTES:SECONDS) | |
|---|---|---|
| SAMPLE NO. | COVER RELEASE | SPRINKLER ACTUATION |
| 1 | 0:48.8 | 1:24.1 |
| 2 | 0:49.6 | 1:26.3 |
| 3 | 0:53.6 | 1:28.3 |
| 4 | 0:53.9 | 1:31.5 |
| 5 | 0:58.2 | 1:38.8 |

The results of a test of five sprinklers having a cover with a single large slot facing the floor, in which the deflector was twelve inches from the ceiling are shown in TABLE II below.

TABLE II

| | OPERATING TIME (MINUTES:SECONDS) | |
|---|---|---|
| SAMPLE NO. | COVER RELEASE | SPRINKLER ACTUATION |
| 1 | 0:44.9 | 1:21.4 |
| 2 | 0:47.3 | 1:22.9 |
| 3 | 0:48.1 | 1:23.5 |
| 4 | 0:48.8 | 1:24.7 |
| 5 | 0:49.8 | 1:25.2 |

The results of a test of ten sprinklers having four slots 74 as described above in connective with a resentative embodiment of the deflector which was twelve inches from the ceiling are shown in TABLE III below.

TABLE III

| | OPERATING TIME (MINUTES:SECONDS) | |
|---|---|---|
| SAMPLE NO. | COVER RELEASE | SPRINKLER ACTUATION |
| 1 | 0:54.3 | 1:03.9 |
| 2 | 1:01.2 | 1:04.2 |
| 3 | 1:02.1 | 1:07.9 |
| 4 | 1:06.6 | 1:09.5 |
| 5 | 1:07.2 | 1:10.2 |
| 6 | 0:48.9 | 0:57 |
| 7 | 0:51.7 | 0:58 |
| 8 | 0:53.3 | 1:01 |
| 9 | 0:53.9 | 1:03 |
| 10 | 0:54 | 1:06 |

The results of a test of ten sprinklers identical to those used in the preceding test but in which the deflector was four inches from the ceiling are shown in Table IV below.

TABLE IV

| | OPERATING TIME (MINUTES:SECONDS) | |
|---|---|---|
| SAMPLE NO. | COVER RELEASE | SPRINKLER ACTUATION |
| 1 | 0:46.2 | 1:05.3 |
| 2 | 0:46.4 | 1:09.2 |
| 3 | 0:46.8 | 1:10.9 |
| 4 | 0:48.9 | 1:14.5 |
| 5 | 0:50.0 | 1:14.8 |
| 6 | 0:42.6 | 1:03.4 |
| 7 | 0:43.4 | 1:06.2 |
| 8 | 0:44.7 | 1:07.3 |
| 9 | 0:47.5 | 1:08.7 |
| 10 | 0:48.7 | 1:11.0 |

As the data from TABLES III and IV demonstrate, the slot and gap configuration of the present invention resulted in cover ejection and sprinkler actuation in less than one minute and fifteen seconds in every case.

Although the invention has been described herein with reference to specific embodiments, many modifications and variations therein will readily occur to those skilled in the art. Accordingly, all such variations and modifications are included within the intended scope of the invention.

I claim:

1. A concealed horizontal sidewall sprinkler arrangement comprising:

a sprinkler body having a mounting end for supporting the sprinkler body in a horizontal orientation and connecting it to a source of fire extinguishing liquid;

a cover support mounted on the sprinkler body;

a cover supported from the cover support through a solder connection;

the cover having a part projecting away from the cover support having at least four slots and being spaced from the cover support by an annular gap; and a plurality of springs interposed between the cover and the cover support for urging the cover away from the cover support and clearing the sprinkler body when the solder connection fuses at elevated temperatures;

wherein the cover support includes a threaded cylindrical wall mounted on the sprinkler body and a sleeve having a cylindrical portion with helically arranged projections and an open ended slot on either side of each of the helically arranged projections forming a segment resiliently biased toward the cylindrical wall for slidable engagement of the cylindrical portion with the threaded cylindrical wall through axial motion.

2. A concealed horizontal sidewall sprinkler arrangement according to claim 1 further comprising a deflector mounted on the sprinkler body to distribute fire extinguishing liquid, the deflector being located substantially inside the projecting part of the cover.

3. A concealed horizontal sidewall sprinkler arrangement according to claim 1 wherein the projecting part of the cover has a frustoconical surface.

4. A concealed horizontal sidewall sprinkler arrangement according to claim 3 wherein the slots are substantially equally spaced around the frustoconical surface of the cover.

5. A concealed horizontal sidewall sprinkler arrangement according to claim 4 wherein each of the slots extends in a plane with the axis of the frustoconically shaped cover.

6. A concealed horizontal sidewall sprinkler arrangement according to claim 1 wherein the plurality of springs comprises two leaf springs.

7. A concealed horizontal sidewall sprinkler arrangement according to claim 6 wherein each of the leaf springs is retained by a tab of the cover support.

8. A concealed horizontal sidewall sprinkler arrangement according to claim 1 wherein one side of the helically arranged projections facing the mounting end of the sprinkler body is sloped and the side of the helically arranged projections facing away from the mounting end of the sprinkler body is an abrupt edge.

9. A concealed horizontal sidewall sprinkler arrangement according to claim 8 wherein the solder connection includes a plurality of tabs on the sleeve which are soldered to a flange on the cover.

10. A sprinkler cover arrangement for a concealed horizontal sidewall sprinkler having a mounting for supporting the sprinkler in a horizontal orientation and connecting it to a source of fire extinguishing liquid, comprising:

a cover support mounted on the sprinkler;

a cover supported from the cover support through a solder connection;

the cover having a part projecting away from the cover support having at least four slots and being spaced from the cover support by an annular gap; and a plurality of springs interposed between the cover and the cover support for urging the cover away from the cover support and clearing the sprinkler when the solder fuses at elevated temperatures;

wherein the cover support includes a threaded cylindrical wall mounted on the sprinkler and a sleeve having a cylindrical portion with helically arranged projections and an open ended slot on either side of each of the helically arranged projections forming a segment resiliently biased toward the cylindrical wall for slidable engagement of the cylindrical portion with the threaded cylindrical wall through axial motion.

11. A sprinkler cover arrangement for a concealed horizontal sidewall sprinkler according to claim 10 wherein the projecting part of the cover has a frustoconical surface.

12. A sprinkler cover arrangement for a concealed horizontal sidewall sprinkler according to claim 11 wherein the slots are substantially equally spaced around the frustoconical surface of the cover.

13. A sprinkler cover arrangement for a concealed horizontal sidewall sprinkler according to claim 12 wherein each of the slots extends in a plane with the axis of the frustoconically shaped cover.

14. A sprinkler cover arrangement for a concealed horizontal sidewall sprinkler according to claim 10 wherein the plurality of springs comprises two leaf springs.

15. A sprinkler cover arrangement for a concealed horizontal sidewall sprinkler according to claim 14 wherein each of the leaf springs is retained by a tab of the cover support.

16. A sprinkler cover arrangement for a concealed horizontal sidewall sprinkler according to claim 14 wherein said leaf spring is M-shaped and is constructed such that when the ends of th e M-shaped spring are squeezed together, the center of the M-shaped spring flattens out easing insertion of the M-shaped spring behind the tab and when the ends of the M-shaped spring are released, the center of the M-shaped spring springs back and retains the M-shaped spring in place behind the tab.

17. A sprinkler cover assembly for a concealed horizontal sprinkler according to claim 10 wherein one side of the helically arranged projections facing the mounting end of the sprinkler is sloped and the side of the helically arranged projections facing away from the mounting end of the sprinkler is an abrupt edge.

18. A sprinkler cover arrangement for a concealed horizontal sidewall sprinkler according to claim 17 wherein the solder connection includes a plurality of tabs on the sleeve which are soldered to a flange on the cover.

* * * * *

UNITED STATES PATENT AND TRADEMARK OFFICE

CERTIFICATE OF CORRECTION

PATENT NO. : 6,374,919 B1
DATED : April 23, 2002
INVENTOR(S) : John Neill

It is certified that error appears in the above-identified patent and that said Letters Patent is hereby corrected as shown below:

Column 1,
Line 14, “pendent-type” should read -- pendant-type --

Column 2,
Line 24, “FIG. 1,” should read -- FIG. 1; --

Column 4,
Line 36, “showing” should read -- shown --
Line 66, “connective” should read -- connection --; and resentative” should read -- representative --

Column 7,
Line 10, “th e” should read -- the --

Signed and Sealed this

Nineteenth Day of November, 2002

*Attest:*

*Attesting Officer*

JAMES E. ROGAN
*Director of the United States Patent and Trademark Office*